US006910937B2

(12) United States Patent
Yoshikawa et al.

(10) Patent No.: US 6,910,937 B2
(45) Date of Patent: Jun. 28, 2005

(54) METHOD FOR FORMING FINE BARRIER, METHOD FOR FABRICATING PLANAR DISPLAY AND ABRASIVE FOR BLAST

(75) Inventors: Eitaro Yoshikawa, Kanagawa (JP); Hiroshi Mori, Kanagawa (JP); Tomohiro Kimura, Tokyo (JP); Hidehiro Kawaguchi, Kanagawa (JP)

(73) Assignee: Sony Corporation (JP)

( * ) Notice: Subject to any disclaimer, the term of this patent is extended or adjusted under 35 U.S.C. 154(b) by 199 days.

(21) Appl. No.: 10/381,416

(22) PCT Filed: Jul. 17, 2002

(86) PCT No.: PCT/JP02/07252

§ 371 (c)(1),
(2), (4) Date: Mar. 25, 2003

(87) PCT Pub. No.: WO03/011526

PCT Pub. Date: Feb. 13, 2003

(65) Prior Publication Data

US 2004/0023590 A1 Feb. 5, 2004

(30) Foreign Application Priority Data

Jul. 30, 2001 (JP) ..... 2001-229139

(51) Int. Cl.[7] ..... H01J 9/00

(52) U.S. Cl. ..... 445/24; 451/38; 451/39; 451/40; 451/41; 451/75; 451/78

(58) Field of Search ..... 451/30, 37–41, 451/75, 78; 445/24

(56) References Cited

U.S. PATENT DOCUMENTS 5,703,433 A * 12/1997 Fujii et al. ..... 313/484
5,990,617 A * 11/1999 Kanae et al. ..... 313/586
6,024,619 A * 2/2000 Mori et al. ..... 445/24

FOREIGN PATENT DOCUMENTS

JP 2 330 943 A1 5/1999
JP 2001-167697 A1 6/2001

OTHER PUBLICATIONS

PCT Search Report.

* cited by examiner

*Primary Examiner*—Mariceli Santiago
(74) *Attorney, Agent, or Firm*—Rader, Fishman & Grauer PLLC; Ronald P. Kananen

(57) ABSTRACT

A method of forming fine partition walls by which fine partition walls with stable shape can be formed with good processing accuracy and at good grinding efficiency by a jet processing technique, a method of producing a planar display device by application of the method, and an abrasive for jet processing to be used in these methods, are disclosed. The fine partition walls are formed on the surface of a substrate by jet processing using an abrasive comprised of a powder of calcium carbonate coated with silicone on the surfaces thereof. Each of the particles constituting the abrasive has a three-dimensional shape comprised of a stack of different-sized triangular or more-angular polygonal layers.

34 Claims, 11 Drawing Sheets

SECTION OF RIB (WHOLE THICKNESS)

BIRD'S-EYE IMAGE

SECTION OF RIB (WHOLE THICKNESS)

BIRD'S-EYE IMAGE

METHOD FOR FORMING FINE BARRIER, METHOD FOR FABRICATING PLANAR DISPLAY AND ABRASIVE FOR BLAST

TECHNICAL FIELD

The present invention relates to a method of forming fine partition walls, a method of producing a planar display device, and an abrasive for jet processing. More particularly, the invention relates to a method of forming fine partition walls by which fine partition walls with a stable shape can be formed with favorable processing accuracy and at high grinding efficiency by use of a jet processing technique, a method of producing a planar display device by application of the method, and an abrasive for jet processing to be used in these methods.

BACKGROUND ART

As a method for forming a fine partition wall of a gas discharge type planar display device, there is a jet processing method such as sandblasting technique. In this method, a low melting point glass paste is coated and dried on a substrate, such as a glass, then a photosensitive dry film resist having sandblast resistance is laminated on the surface of the dried paste layer, and light exposure and development in a predetermined pattern is conducted by use of a glass mask. Thereafter, an abrasive is jetted by a sandblasting technique, to process into the patterned shape. As the abrasive used herein, calcium carbonate or glass beads are used.

However, calcium carbonate has the property of adhering to the work, and it becomes difficult for calcium carbonate to be removed as the pattern of the partition wall becomes finer.

In addition, the glass beads have the demerit of low processing speed due to the spherical shape thereof, and, since it is difficult to obtain a small grain diameter, the glass beads are not easily available.

Further, in recent years, attendant on the increases in the fineness and luminance of the planar type display panel, it has been desired to reduce the pitch of the partition walls and the width of the partition walls. In order to form fine partition walls, the following problems must be solved.

First, it is demanded to make the grain diameter of the abrasive finer and to secure the processing properties and water repellency.

In addition, there are demands for the resolution and reduction of thickness of the resist corresponding to the fine patterning and the properties for adhesion to and release from the work.

Furthermore, it is demanded to make the particles of the low melting point glass paste finer and to enhance the shape retainability.

The present invention has been made in consideration of the above circumstances. Accordingly, it is an object of the present invention to provide a method of forming a fine partition wall by which a fine partition wall with stable shape can be formed with good processing accuracy and at high grinding efficiency by use of a jet processing technique, a method of producing a planar display device by application of the method, and an abrasive for jet processing to be used in these methods.

DISCLOSURE OF INVENTION

In order to attain the above object, a method of forming fine partition walls according to the present invention is characterized in that fine partition walls are formed on the surface of a substrate by jet processing using an abrasive comprised of a powder of calcium carbonate coated with silicone on the surfaces thereof.

A method of producing a planar display device according to the present invention is a method of producing a plasma planar display device comprising a first panel and a second panel, with discharge spaces being formed between the first panel and the second panel, wherein partition walls for partitioning the discharge spaces are formed on the surface of a second substrate constituting the second panel by jet processing using an abrasive comprised of a powder of calcium carbonate coated with silicone on the surfaces thereof.

An abrasive for jet processing according to the present invention is an abrasive for jet processing which is comprised of a powder of calcium carbonate coated with silicone on the surfaces thereof.

Preferably, each of the particles constituting the abrasive has a three-dimensional shape comprised of a stack of different-sized triangular or more-angular polygonal layers.

Preferably, the maximum particle diameter of the abrasive is not more than ½ times the width of the fine partition walls, and the mean particle diameter of the abrasive is not more than ⅕ times the width of the fine partition walls. Further, preferably, the maximum particle diameter of the abrasive is not more than 10 $\mu$m.

Preferably, the pitch of the fine partition walls is not more than 150 $\mu$m, for example, 50 to 100 $\mu$m, the width of the fine partition walls is not more than 50 $\mu$m, for example, 10 to 35 $\mu$m, and the height of the fine partition walls is not more than 300 $\mu$m, for example, 100 to 200 $\mu$m.

Preferably, the thickness of the resist layer used for forming the fine partition walls in the predetermined pattern is not more than 1.2 times the width of the fine partition walls. In the present invention, the resist layer is not particularly limited, and a liquid, paste or film forming a resist layer having sandblast resistance may be used. As the film forming the resist layer, for example, one comprising a photosensitive paste laminated between resin films or the like may be used. As the resin film, for example, a polyethylene terephthalate (PET) film may be used.

Preferably, the particle diameter of various frits constituting the low melting point glass paste for forming the fine partition walls is not more than ⅕ times the width of the fine partition walls. The low melting point glass paste is not particularly limited, and either a lead-containing paste or a lead-free paste may be used; particularly, a lead-free paste is preferable.

In the abrasive according to the present invention, the surfaces of calcium carbonate are coated with silicone, whereby excellent water repellency and fluidity are ensured. Therefore, when jet processing, such as sandblasting, is conducted by use of this abrasive, the abrasive can be effectively prevented from leaving by adhering to the fine partition walls as the work or in grooves, and it can be cleanly removed at the time of forming the fine partition walls in the predetermined pattern.

In addition, in the present invention, each of the particles constituting the abrasive has the three-dimensional shape comprised of a stack of different-sized triangular or more-angular polygonal layers, whereby the fine partition walls can be formed at good grinding efficiency and with good accuracy even where the mean particle diameter is set to be small.

Further, the maximum particle diameter of the abrasive is set to be not more than ½ times the width of the fine partition walls, and the mean particle diameter of the abrasive is set to be not more than ⅕ times the width of the fine partition walls, whereby the partition walls having a fine pitch and a fine width can be processed without damaging the shape thereof. Particularly, by setting the maximum particle diameter of the abrasive to be not more than 10 μm, the partition walls with the fine pitch and the fine width can be processed without damaging the shape thereof.

The pitch of the fine partition walls formed by the method according to the present invention is not particularly limited, and a pitch of not more than 150 μm can be adopted. In addition, the width of the fine partition walls can be not more than 50 μm, and the height of the fine partition walls can be not more than 300 μm.

In the present invention, the thickness of the resist layer used for forming the fine partition walls in the predetermined pattern is set to be not more than 1.2 times the width of the fine partition walls, whereby a pattern with a fine width free of exfoliation, collapse or undulation can be formed, adhesion of the resist layer to the low melting point glass paste is secured, and the formation of a partition wall pattern having a fine pitch and a fine width is facilitated.

The particle diameter of various frits constituting the low melting point glass paste for forming the fine partition walls is set to be not more than ⅕ times the width of the fine partition walls, whereby partition walls which are fine and stable in shape can be formed.

According to the present invention, it is possible to provide a method of forming fine partition walls by which fine partition walls with stable shape can be formed with good processing accuracy and at high grinding efficiency by use of a jet processing technique, a method of producing a planar display device by application of the method, and an abrasive for jet processing to be used in these methods.

BEST MODE FOR CARRYING OUT THE INVENTION

Figure 1:
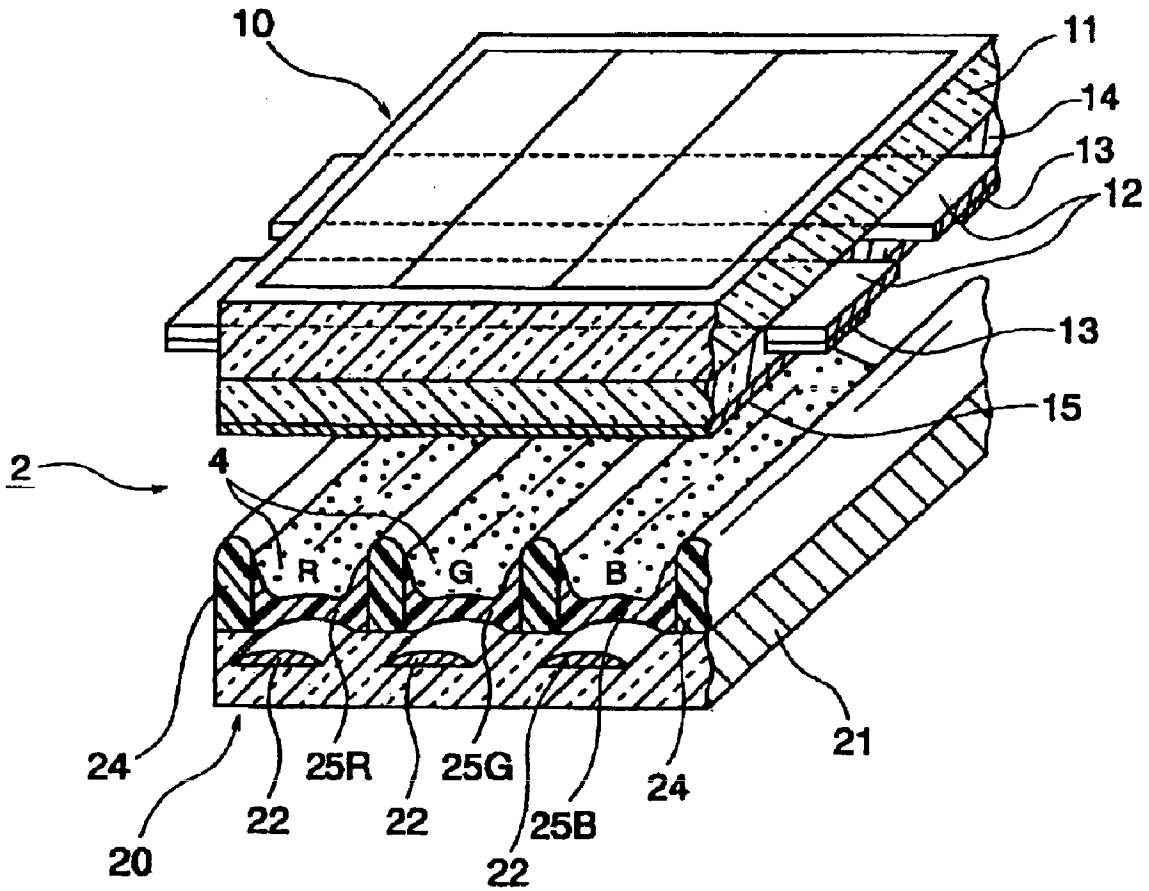
FIG. 1 is a sectional view of a major part of a planar display device according to one embodiment of the present invention.
Figure 2:
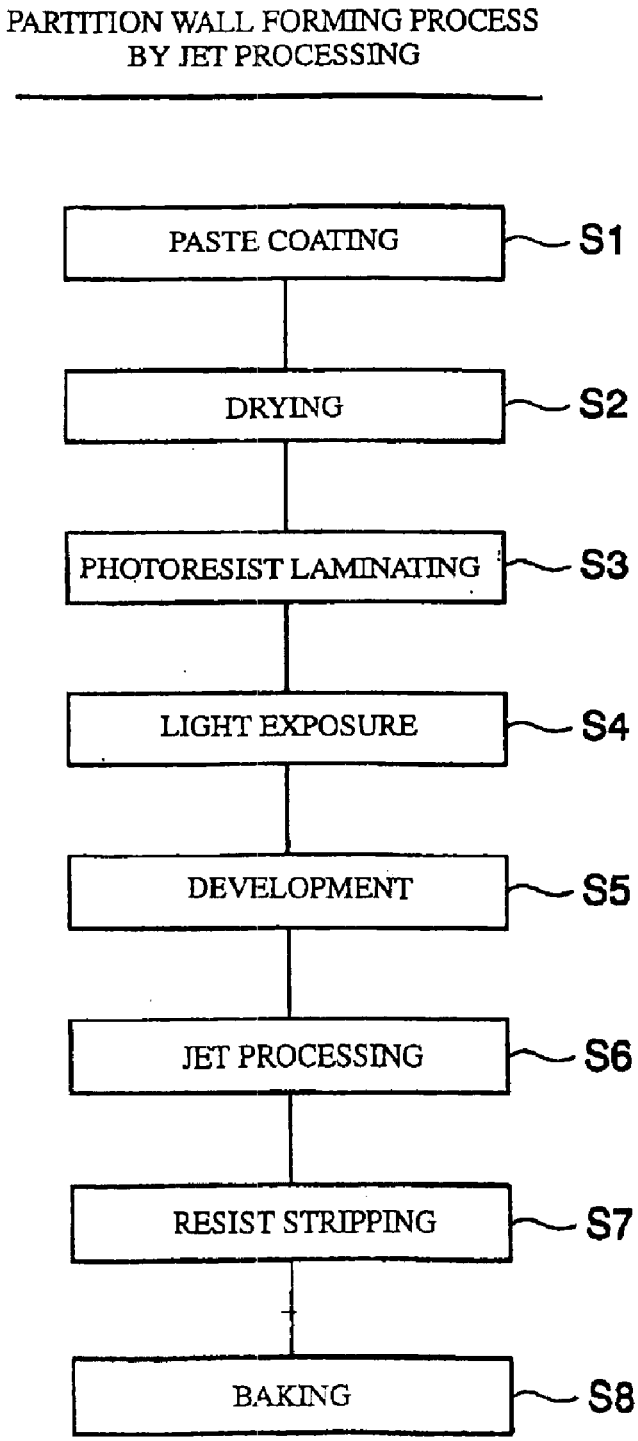
FIG. 2 is a flow chart showing a process of forming partition walls of the planar display device shown in FIG. 1.
Figure 3A:
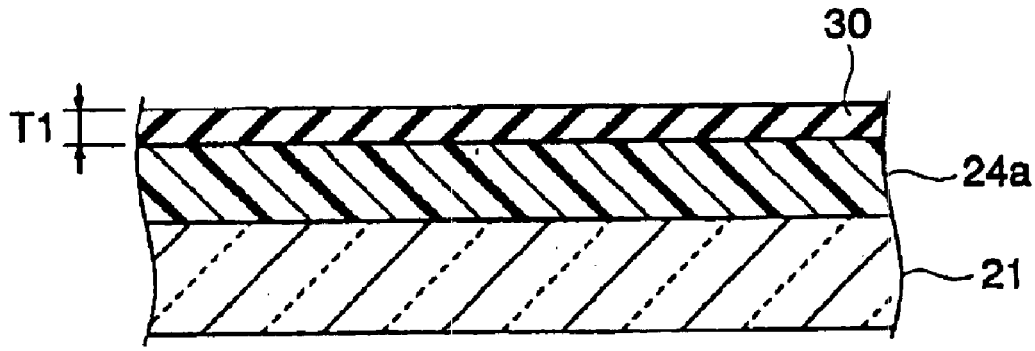
FIGS. 3A to 3C are sectional views of a major part showing the process of forming the walls.
Figure 3B:
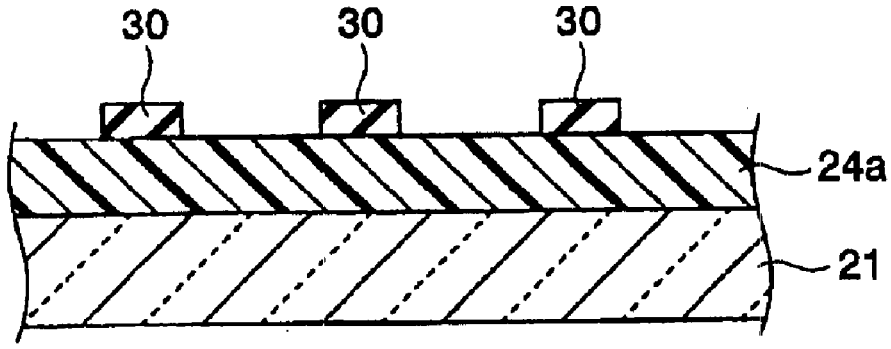
Figure 3C:
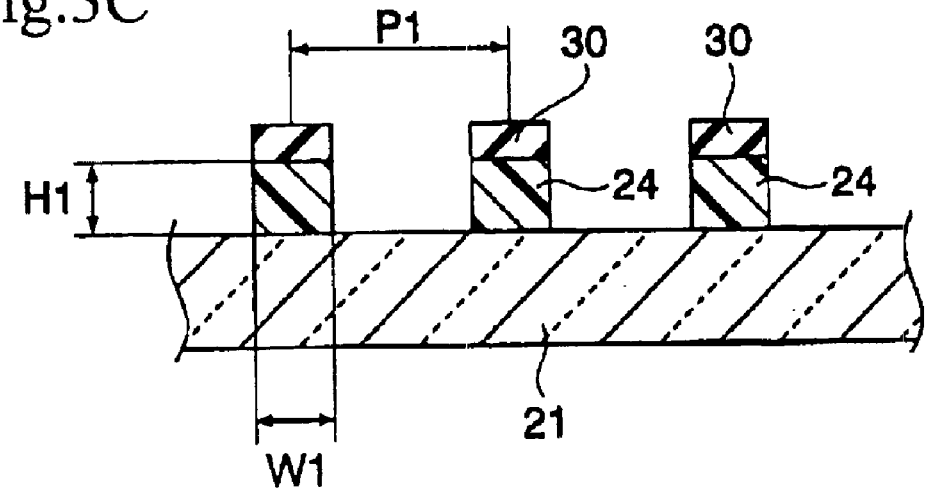
Figure 4:
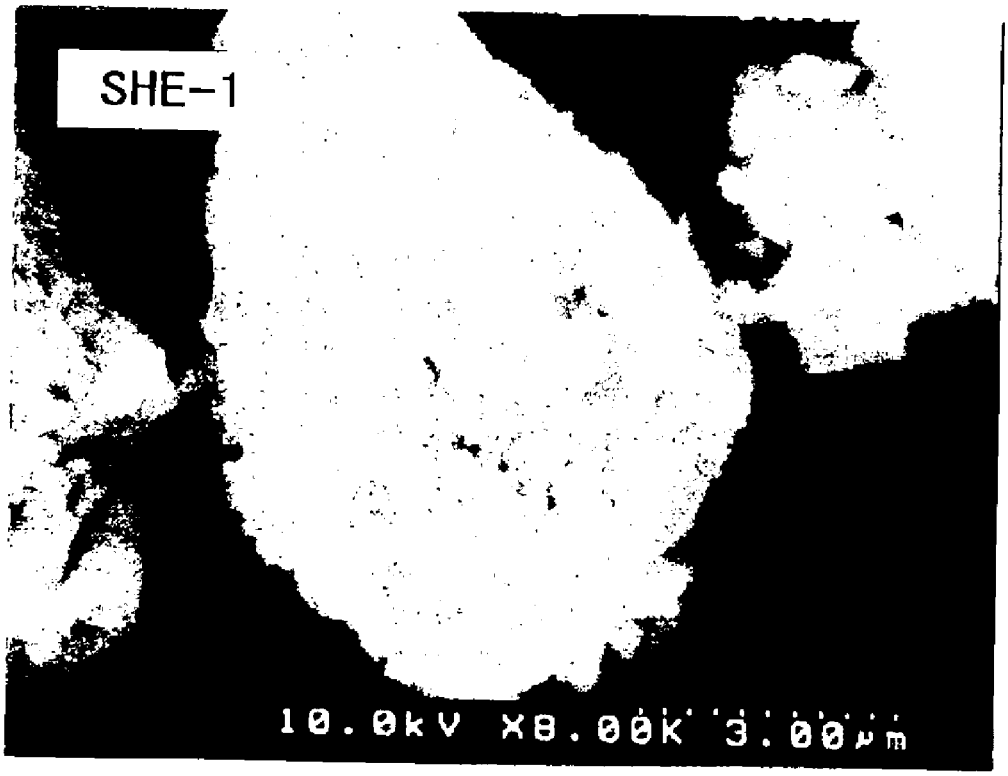
FIG. 4 is a microphotograph of an abrasive used in jet processing according to one example of the present invention.
Figure 5:
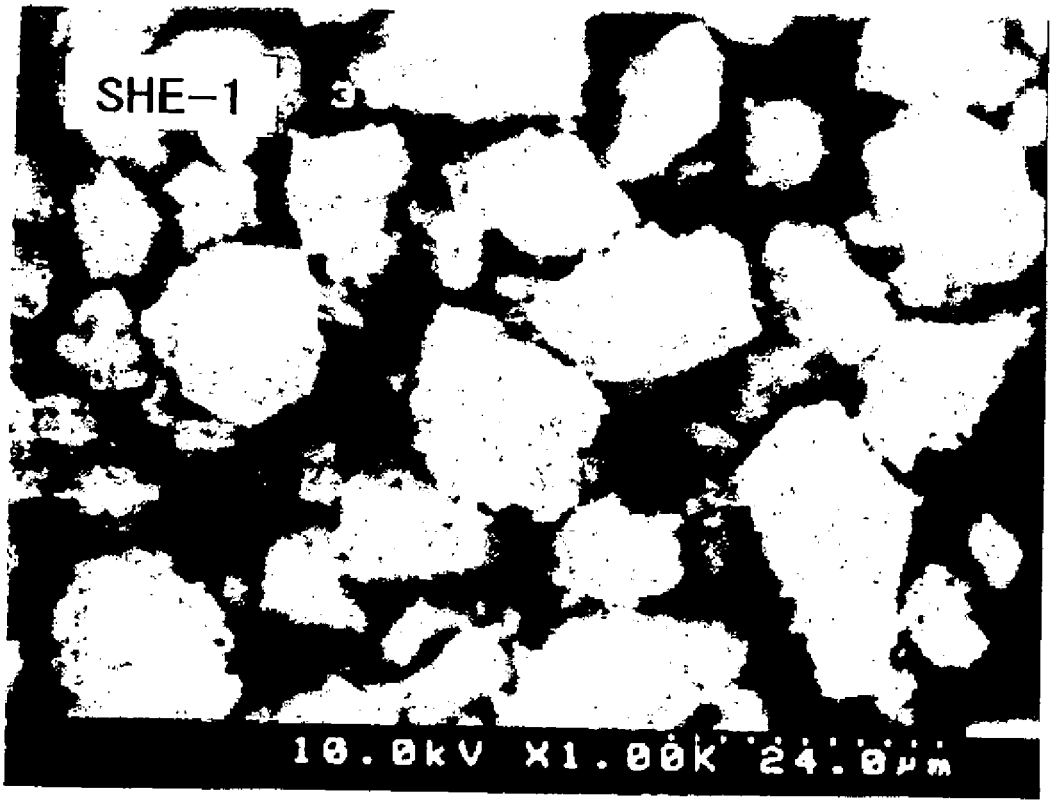
FIG. 5 is a microphotograph at a magnification different from that of FIG. 4.
Figure 6:
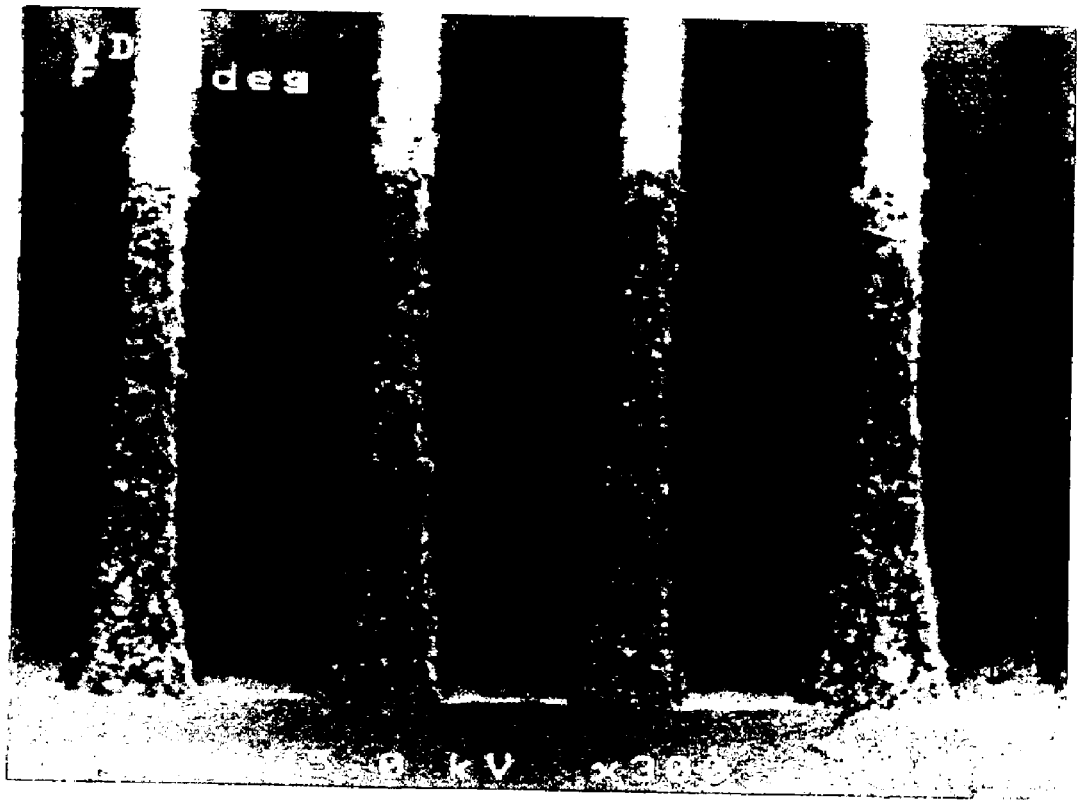
FIG. 6 is a microphotograph of a fine partition wall processed by the jet processing using the abrasive shown in FIGS. 4 and 5.
Figure 7:
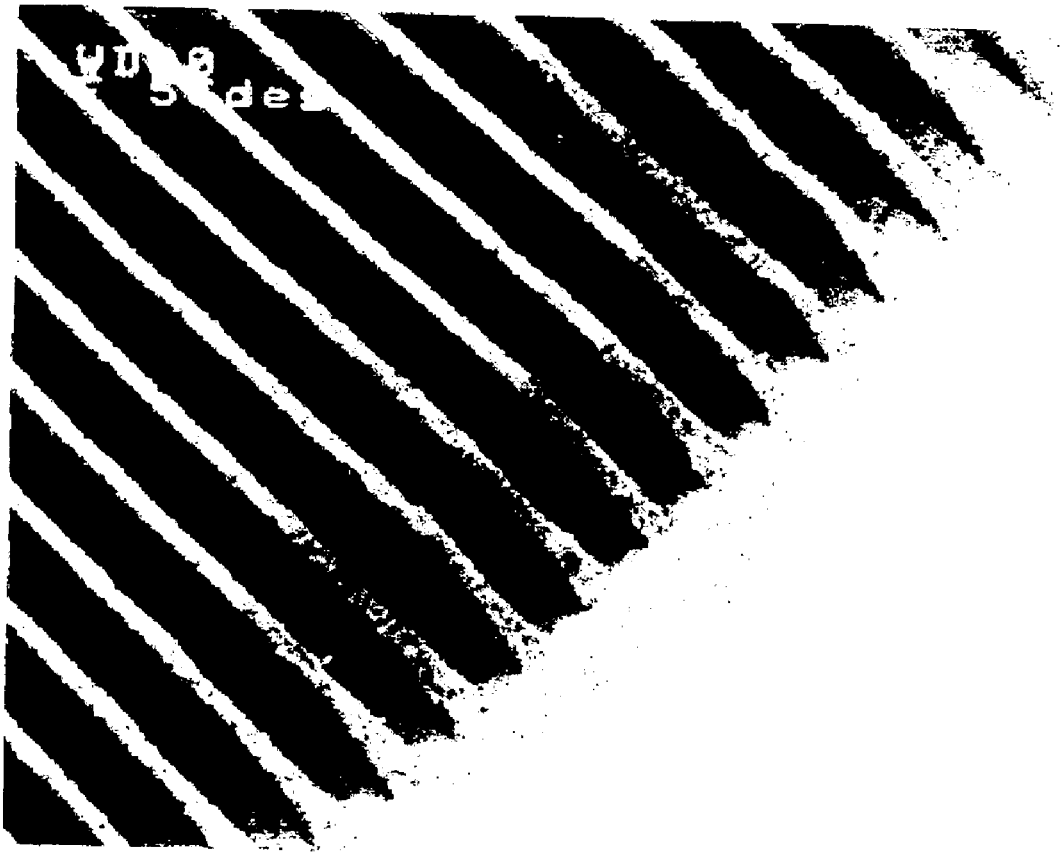
FIG. 7 is a microphotograph at a magnification different from that of FIG. 6.
Figure 8:
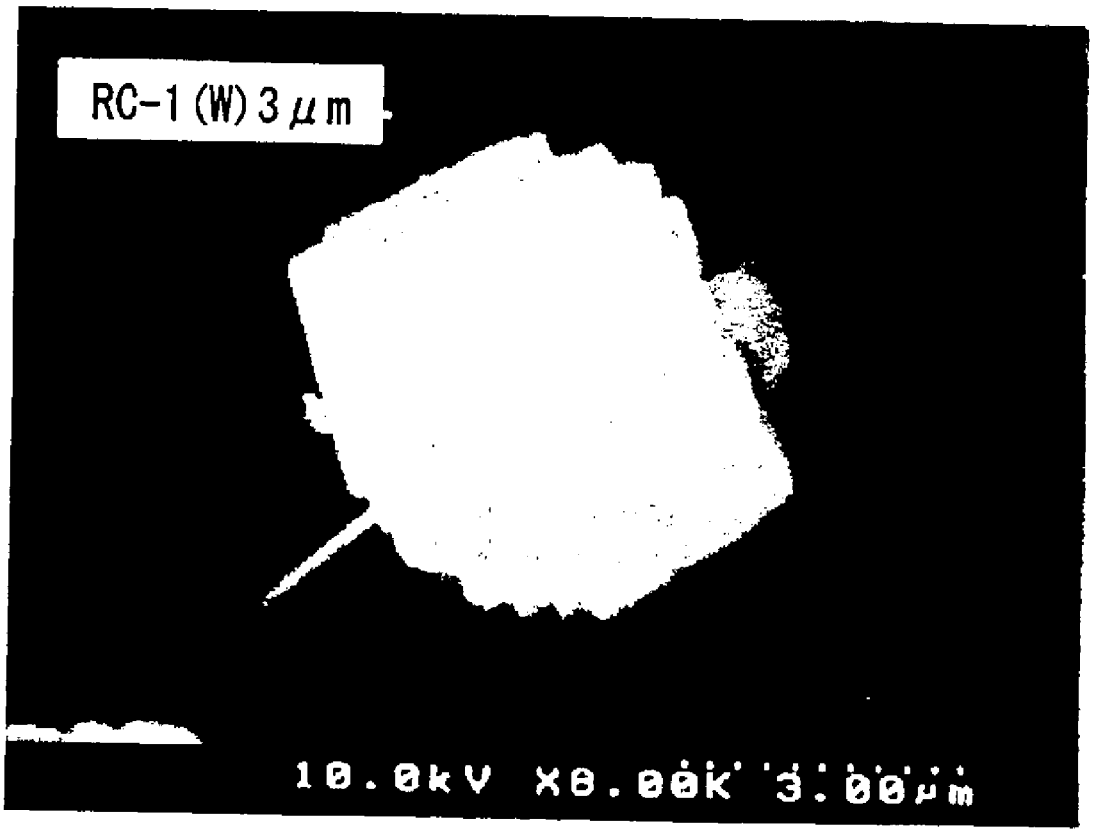
FIG. 8 is a microphotograph of an abrasive used in the jet processing according to another example of the present invention.
Figure 9:
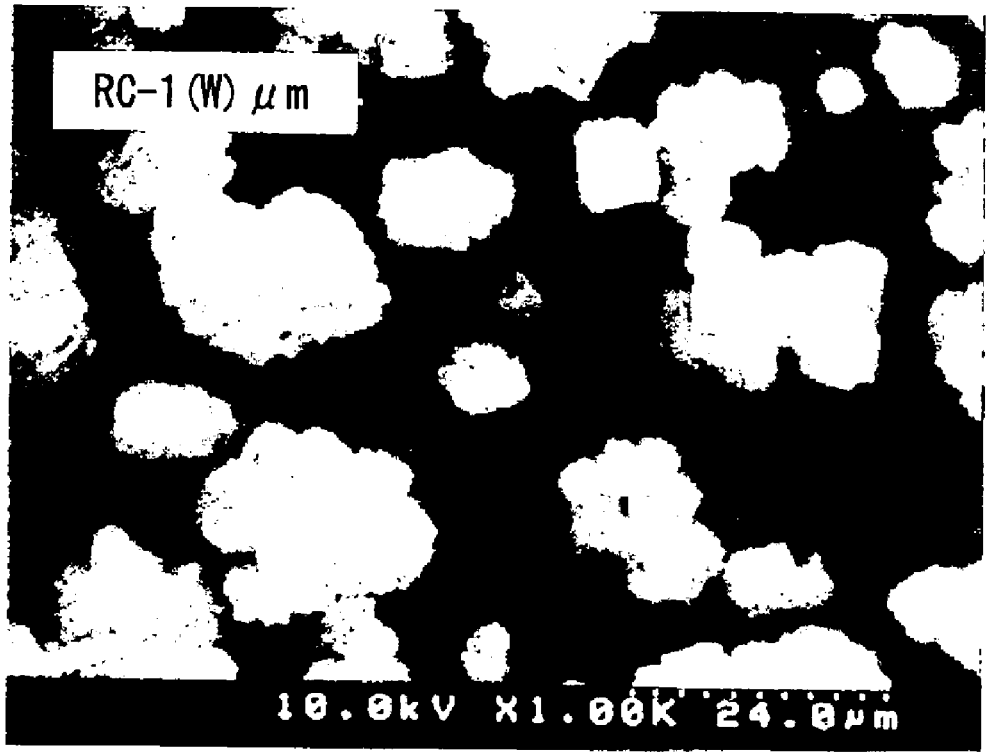
FIG. 9 is a microphotograph at a magnification different from that of FIG. 8.
Figure 10:
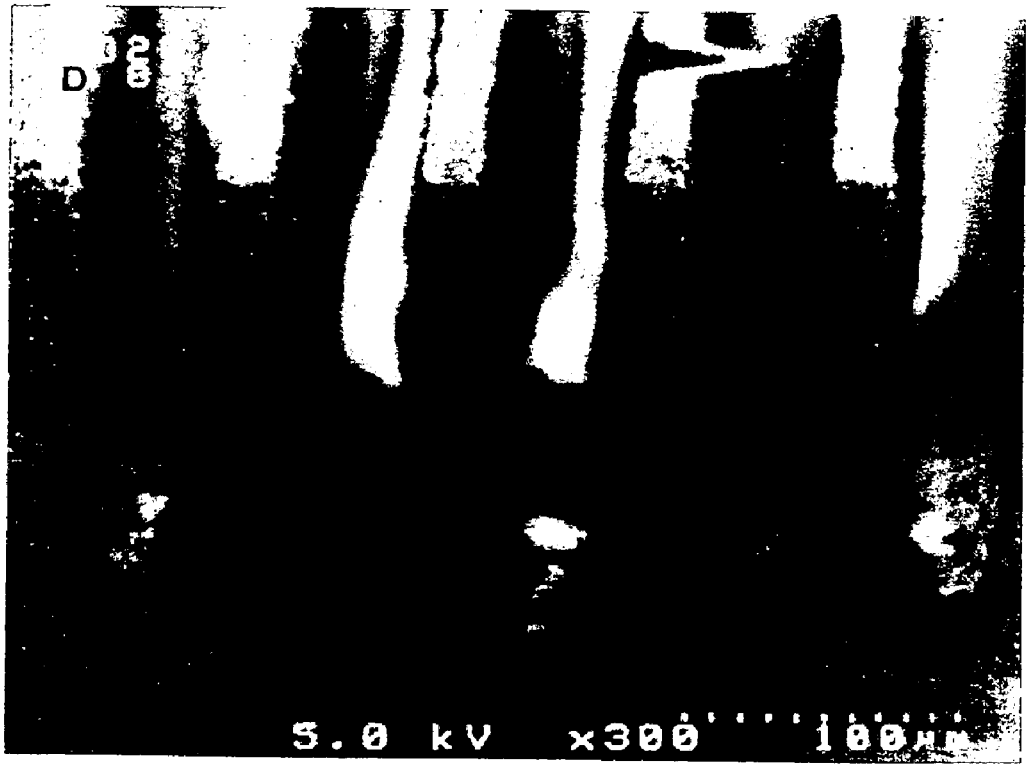
FIG. 10 is a microphotograph of a fine partition wall processed by the jet processing using the abrasive shown in FIGS. 8 and 9.
Figure 11:
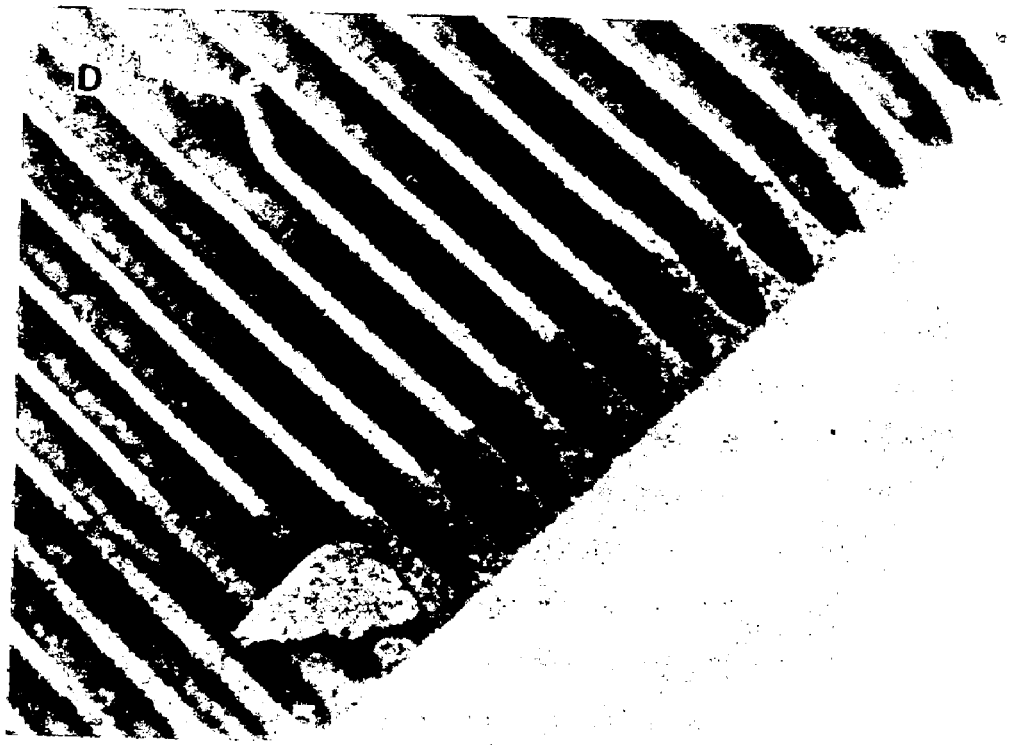
FIG. 11 is a microphotograph at a magnification different from that of FIG. 10.

Now, the present invention will be described based on an embodiment shown in the drawings, in which:

FIG. 1 is a sectional view of a major part of a planar display device according to one embodiment of the present invention;

FIG. 2 is a flow chart showing a process of forming partition walls of the planar display device shown in FIG. 1;

FIGS. 3A to 3C are sectional views of a major part showing the process of forming the partition walls;

FIGS. 4 and 5 are microphotographs at different magnifications of an abrasive used in jet processing according to one example of the present invention;

FIGS. 6 and 7 are microphotographs at different magnifications of a fine partition wall processed by the jet processing using the abrasive shown in FIGS. 4 and 5;

FIGS. 8 and 9 are microphotographs at different magnifications of an abrasive used in the jet processing according to another example of the present invention;

FIGS. 10 and 11 are microphotographs at different magnifications of a fine partition wall processed by the jet processing using the abrasive shown in FIGS. 8 and 9.

Overall Structure of Plasma Planar Display Device

First, based on FIG. 1, the overall structure of an alternate current driving-type (AC-type) plasma planar display device (hereinafter referred to simply as "the plasma display device" in some cases) will be described.

The AC-type plasma planar display device 2 shown in FIG. 1 belongs to the so-called three-electrode type, and discharge occurs between a pair of discharge sustaining electrodes 12. The AC-type plasma display device 2 includes a first panel 10 corresponding to a front panel, and a second panel 20 corresponding to a rear panel, which are laminated on each other. Light emission from phosphor layers 25R, 25G, 25B on the second panel 20 is, for example, observed through the first panel 10. Namely, the first panel 10 is on the display surface side.

The first panel 10 includes a transparent first substrate 11, a plurality of pairs of discharge sustaining electrodes 12 provided on the first substrate 11 in a stripe pattern and composed of a transparent conductive material, bus electrodes 13 provided for lowering the impedance of the discharge sustaining electrodes 12 and formed of a material having an electric resistivity lower than that of the discharge sustaining electrodes 12, a dielectric layer 14 provided on the first substrate 11 inclusive of the areas on the bus electrodes 13 and the discharge sustaining electrodes 12, and a protective layer 15 provided thereon. Incidentally, the protective layer 15 may not necessarily be provided, but it is preferable that the protective layer 15 is provided.

On the other hand, the second panel 20 includes a second substrate 21, a plurality of address electrodes (also called "data electrodes") 22 provided on the second substrate 21 in a stripe pattern, a dielectric film (omitted in the figure) provided on the second substrate 21 inclusive of the areas on the address electrodes 22, insulating partition walls 24 extending in parallel to the address electrodes 22 on the dielectric film and in the regions between the adjacent address electrodes 22, and phosphor layers provided over the region ranging from the area on the dielectric film to the areas on side walls of the partition walls. The phosphor layers consist of red phosphor layers 25R, green phosphor layers 25G, and blue phosphor layers 25B.

FIG. 1 is a partly-exploded perspective view of the display device; in practice, the top portions of the partition walls 24 on the side of the second panel 20 make contact with the protective layer 15 on the side of the first panel 10. The region where one pair of the discharge sustaining electrodes 12 overlaps with the address electrode 22 located between two partition walls 24 corresponds to a single discharge cell. A discharge gas is sealed in each discharge space 4 surrounded by the adjacent partition walls 24, the phosphor layer 25R, 25G, 25B, and the protective layer 15. The first panel 10 and the second panel 20 are joined to each other with a frit glass at peripheral portions thereof.

The discharge gas to be sealed in the discharge spaces 4 is not specifically limited, and an inert gas such as xenon (Xe) gas, neon (Ne) gas, helium (He) gas, argon (Ar) gas, nitrogen ($N_2$) gas, and the like, or a mixture gas of these inert gases, may be used. The total pressure of the discharge gas thus sealed in is not specifically limited, and may be about $6\times10^3$ to $8\times10^4$ Pa.

The direction in which a projection image of the discharge sustaining electrodes 12 extends and the direction in which a projection image of the address electrodes 22 extends are roughly orthogonal (however, they may not necessarily be orthogonal), and the region where one pair of the discharge sustaining electrodes 12 overlap with one set of the phosphor layers 25R, 25G, and 25B for emitting light in three primary colors corresponds to one pixel. Since glow discharge occurs between one pair of the discharge sustaining electrodes 12, this type of plasma display device is called "the plane discharge type". Immediately before impressing a voltage between the pairs of the discharge sustaining electrodes 12, a panel voltage lower, for example, than the discharge beginning voltage of the discharge cells is impressed on the address electrodes 22, whereby wall charges are accumulated in the discharge cells (selection of the discharge cells for display), and the apparent discharge beginning voltage is lowered. Next, the discharge begun between the pairs of the discharge sustaining electrodes 12 can be maintained at a voltage lower than the discharge beginning voltage. In the discharge cell, the phosphor layer excited by irradiation with vacuum ultraviolet rays generated based on the glow discharge in the discharge gas emits light in a color peculiar to the kind of the material of the phosphor layer. In this case, vacuum ultraviolet rays with a wavelength according to the kind of the discharge gas sealed in are generated.

The plasma planar display device 2 according to the present embodiment is of the so-called reflection-type plasma display device, and the light emission from the phosphor layers 25R, 25G, 25B is observed through the first panel 10. Therefore, the conductive material constituting the address electrodes 22 may be transparent or opaque, but, on the other hand, the conductive material constituting the discharge sustaining electrodes 12 must be transparent. The terms "transparent" and "opaque" here are based on the light transmission property of the conductive materials for the light emission wavelengths (in the visible region) peculiar to the materials of the phosphor layers. Namely, if the conductive material constituting the discharge sustaining electrodes or the address electrodes is transparent to the light emitted from the phosphor layers, the conductive material can be said to be transparent.

As the opaque conductive material, there can be used such materials as Ni, Al, Au, Ag, Al, Pd/Ag, Cr, Ta, Cu, Ba, $LaB_6$, $Ca_{0.2}La_{0.8}CrO_3$, and the like, either singly or in appropriate combinations. Examples of transparent conductive materials include ITO (indium tin oxide) and $SnO_2$. The discharge sustaining electrodes 12 or the address electrodes 22 can be formed by a sputtering method, a vapor deposition method, a screen printing method, a sandblasting method, a plating method, a liftoff method, or the like.

The width of the discharge sustaining electrodes 12 is not specifically limited and may be about 200 to 400 $\mu$m. In addition, the distance between each pair of the discharge sustaining electrodes 12 is not particularly limited and is preferably about 5 to 150 $\mu$m. Further, the width of the address electrodes 22 is, for example, about 50 to 100 $\mu$m.

The bus electrodes 13 can typically be composed of a single-layer metallic film of a metallic material, for example, Ag, Au, Al, Ni, Cu, Mo, Cr or the like, or a laminated film of Cr/Cu/Cr or the like. In the reflection type plasma display device, the bus electrodes 13 formed of such a metallic material may reduce the quantity of light transmitted through the first substrate 11 after being emitted from the phosphor layer, thereby possibly causing a lowering in the luminance of the display screen. Therefore, it is desirable that the bus electrodes 13 should be formed to be as thin as possible, in such a range that the electrical resistance required for the entire discharge sustaining electrodes can be obtained. Specifically, the width of the bus electrodes 13 is smaller than the width of the discharge sustaining electrodes 12, and is, for example, about 30 to 200 $\mu$m. The bus electrodes 13 can be formed by a sputtering method, a vapor deposition method, a screen printing method, a sandblasting method, a plating method, a lift-off method, or the like.

The dielectric layer 14 formed on the surfaces of the discharge sustaining electrodes 12 is preferably formed based on, for example, an electron beam vapor deposition method, a sputtering method, a vapor deposition method, a screen printing method, or the like. By providing the dielectric layer 14, it is possible to prevent ions or electrons generated in the discharge spaces 4 from making direct contact with the discharge sustaining electrodes 12. As a result, abrasion of the discharge sustaining electrodes 12 can be obviated. The dielectric layer 14 has the function of accumulating the wall charges generated in the address period, the function as a resistor for restraining an excessive discharge current, and a memory function of maintaining the discharge condition. The dielectric layer 14 can typically be formed of a low melting point glass and also may be formed by use of other dielectric material.

The protective layer 15 formed on the surface of the dielectric layer 14 on the discharge space side displays an action of preventing direct contact between the ions or electrons and the discharge sustaining electrodes. As a result, abrasion of the discharge sustaining electrodes 12 can be prevented effectively. In addition, the protective layer 15 also has the function of releasing secondary electrons necessary for discharge. Examples of the material for constituting the protective layer 15 include magnesium oxide (MgO), magnesium fluoride ($MgF_2$), and calcium fluoride ($CaF_2$). Among others, magnesium oxide is a preferable material which has the characteristic features of chemical stability, a low sputtering factor, high transmittance at the light emission wavelengths of the phosphor layers, and a low discharge beginning voltage. Incidentally, the protective layer 15 may have a laminated film structure composed of at least two materials selected from the group consisting of the just-mentioned materials.

Examples of the materials for constituting the first substrate 11 and the second substrate 21 include a high strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$). The materials constituting the first substrate 11 and the second substrate 21 may be the same as each other or different from each other.

The phosphor layers 25R, 25G, 25B are, for example, composed of phosphor layer materials selected from the group consisting of phosphor layer materials for emitting light in red, phosphor layer materials for emitting light in green, and phosphor layer materials for emitting light in blue, and they are provided on the upper side of the address electrodes 22. Where the plasma display device is designed for color display, specifically, for example, the phosphor layer formed of the phosphor layer material for emitting light in red (red phosphor layer 25R) is provided on the upper side of one group of the address electrodes 22, the phosphor layer formed of the phosphor layer material for emitting light in green (green phosphor layer 25G) is provided on the upper side of another group of the address electrodes 22, and the phosphor layer formed of the phosphor layer material for emitting light in blue (blue phosphor layer 25B) is provided on the upper side of a further group of the address electrodes 22, and these phosphor layers for emitting light in three primary colors which constitute one set are provided in a predetermined order. As has been described above, the region where one pair of the discharge sustaining electrodes 12 overlap with one set of the phosphor layers 25R, 25G, 25B for emitting light in three primary colors corresponds to one pixel. The red phosphor layer, the green phosphor layer and the blue phosphor layer may be formed in a stripe pattern or in a lattice pattern.

As the phosphor layer materials for constituting the phosphor layers 25R, 25G, 25B, those phosphor layer materials which have high quantum efficiency and little saturation to vacuum ultraviolet rays can appropriately be selected from conventionally-known phosphor layer materials and can be used. Where color display is presumed, it is preferable to combine such phosphor layer materials in which the color purities are close to the three primary colors specified by NTSC, a good white balance can be obtained when the three primary colors are mixed, the afterglow times are short, and the afterglow times of the three primary colors are substantially equal.

Specific examples of the phosphor layer materials are now given below. Examples of the phosphor layer material for emitting light in red include ($Y_2O_3$:Eu), ($YBO_3$:Eu), ($YVO_4$:Eu), $Y_{0.96}P_{0.60}V_{0.40}O_4$:$Eu_{0.04}$), [(Y,Gd)$BO_3$:Eu], ($GdBO_3$:Eu), ($ScBO_3$:Eu), and (3.5MgO.0.5$MgF_2$.$GeO_2$:Mn). Examples of the phosphor layer material for emitting light in green include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb), and ($Sr_4Si_3O_8Cl_4$:Eu). Examples of the phosphor layer material for emitting light in blue include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu), and ($Sr_2P_2O_7$:Sn).

Examples of the method for forming the phosphor layers 25R, 25G, 25B include a thick film printing method, a method of spraying phosphor layer particles, a method of preliminarily applying a sticky substance to prescribed phosphor layer formation areas and then adhering phosphor layer particles to the sticky substance, a method of using photosensitive phosphor layer pastes and patterning the phosphor layers by light exposure and development, and a method of forming a phosphor layer on the whole surface and thereafter removing unrequired portions of the phosphor layer by a sandblasting technique.

Incidentally, the phosphor layers 25R, 25G, 25B may be formed directly on the address electrodes 22 or may be formed over the region ranging from the areas on the address electrodes 22 to the areas on side walls of the partition walls 24. Or, the phosphor layers 25R, 25G, 25B may be formed on the dielectric film provided on the address electrodes 22, or they may be formed over the region ranging from the areas on the dielectric film provided on the address electrodes 22 to the areas on side walls of the partition walls 24. Further, the phosphor layers 25R, 25G, 25B may be formed only on the side walls of the partition walls 24. Examples of the material for constituting the dielectric film include low melting point glass and $SiO_2$.

On the second substrate 21, there are provided the partition walls 24 (ribs) extending in parallel to the address electrodes 22, as has been described above. Incidentally, the partition walls (ribs) 24 may have a meander structure. Where the dielectric film is provided on the second substrate 21 and the address electrodes 22, the partition walls 24 may be formed on the dielectric film. As the material for constituting the partition walls 24, conventionally-known insulating materials can be used. For example, a material prepared by mixing a metallic oxide, such as alumina, into a low melting point glass which is widely used can be used. The partition walls 24, for example, have a thickness of not more than about 50 $\mu$m, preferably 10 to 35 $\mu$m, and a height of not more than 300 $\mu$m, preferably about 100 to 200 $\mu$m. The pitch of the partition walls 24 is, for example, about 50 to 400 $\mu$m, preferably not more than 150 $\mu$m. The method of forming the partition walls 24 will be described later.

One pair of the partition walls 24 is formed on the second substrate 21, and the discharge sustaining electrodes 12, the address electrode 22 and the phosphor layer 25R, 25G, 25B occupying the region surrounded by the one pair of the partition walls 24 constitute one discharge cell. In the inside of each such discharge cell, more specifically, in the inside of the discharge space surrounded by the partition walls, a discharge gas consisting of a mixture gas is sealed. The phosphor layer 25R, 25G, 25B emit light upon being irradiated with ultraviolet rays generated based on the AC glow discharge generated in the discharge gas inside the discharge space 4.

Method of Producing the Plasma Display Device

Hereinafter, a method of producing the plasma display device according to the present invention will be described.

The first panel 10 can be produced by the method as follows. First, an ITO layer is formed on the whole surface of the first substrate 11 formed of high strain point glass or soda glass by a sputtering method, for example, and the ITO layer is patterned into a stripe form by a photolithography technique and an etching technique, whereby a plurality of pairs of discharge sustaining electrodes 12 are formed. The discharge sustaining electrodes 12 extend in a first direction.

Next, an aluminum film is formed on the whole inside surface of the first substrate 11 by a vapor deposition method, for example, and the aluminum film is patterned by a photolithography technique and an etching technique, whereby bus electrodes 13 are formed along edge portions of each of the discharge sustaining electrodes 12. Thereafter, a dielectric layer 14 formed of $SiO_2$ is formed on the whole inside surface of the first substrate 11 provided with the bus electrodes 13, and a protective layer 15 formed of magnesium oxide (MgO) with a thickness of 0.6 $\mu$m is formed thereon by an electron beam vapor deposition method. By these steps, the first panel 10 can be completed.

The second panel 20 is produced by the following method. First, an aluminum film is formed on a second substrate 21 formed of high strain point glass or soda glass by a vapor deposition method, for example, and the aluminum film is patterned by a photolithography technique and an etching technique, whereby address electrodes 22 are formed. The address electrodes 22 extend in a second direction orthogonal to the first direction. Next, a low melting point glass paste layer is formed on the entire surface by a screen printing method, and the low melting point glass paste layer is baked, to thereby form a dielectric film.

Thereafter, partition walls 24 in a fine stripe pattern are each formed on the dielectric film on the upper side of each region between the adjacent address electrodes 22 by the following method.

First, in step S1 shown in FIG. 2, a low melting point glass paste is coated in a predetermined thickness by, for example, a screen printing method or one of various coater methods, to form a partition wall layer 24*a* on the surface of the second substrate 21, as shown in FIG. 3A. In this case, the particle diameter of various frits constituting the low melting point glass paste for forming the partition wall layer 24*a* is set to be not more than ⅕ times the partition wall width W1 shown in FIG. 3C to be obtained.

Next, in step S2 shown in FIG. 2, the second substrate 21 provided with the partition wall layer 24*a* is left to stand naturally (curing) for several minutes, and it is then dried in a drying furnace to evaporate off the solvent components contained in the partition wall layer 24*a*. The thickness of the partition wall layer 24*a* after the drying is not more than 300 μm. Incidentally, in FIGS. 3A to 3C, the address electrodes 22 and the like shown in FIG. 1 are omitted.

Next, in step S3 shown in FIG. 2, a photosensitive dry film resist film 30 is laminated on the surface of the partition wall layer 24*a* that is in the warm state after the drying by use of a laminator or the like, as shown in FIG. 3A. The thickness T1 of the resist film 30 is not more than 1.2 times the width W1 of the partition walls 24 to be obtained (See FIG. 3C). The photosensitive resist film 30, for example, has a laminated structure in which a photosensitive paste layer is sandwiched between PET films.

In step S4 shown in FIG. 2, the resist film 30 is subjected to light exposure by use of a photomask patterned into a predetermined shape. Next, in step S5 shown in FIG. 2, the second substrate 21, having undergone the light exposure in the predetermined shape pattern, is developed with an aqueous basic solution to remove the resist from the unexposed areas, thereby obtaining a resist pattern in a predetermined partition wall shape. This condition is shown in FIG. 3B.

Thereafter, in step S6 shown in FIG. 2, an abrasive is jetted by a sandblasting method (a kind of jet processing method) to grind away the partition wall layer 24*a* in the areas where the resist film 30 has been removed, to thereby form partition walls 24 in a predetermined pattern. This condition is shown in FIG. 3C.

As the abrasive in the present embodiment, there is used an abrasive consisting of a powder of calcium carbonate coated with silicone on the surfaces thereof. In the present embodiment, as shown in FIGS. 4 and 5 or in FIGS. 8 and 9, each of the particles constituting the abrasive has a three-dimensional shape composed of a stack of different-sized tetrangular or more-angular polygonal layers. In addition, the maximum particle diameter of the abrasive is not more than ½ times the width W1 of the partition walls 24, and the mean particle diameter of the abrasive is not more than ⅕ times the width W1 of the partition walls 24. Besides, the maximum particle diameter of the abrasive is not more than 10 μm.

Thereafter, in step S7 shown in FIG. 2, the resist film 30 having not been removed by the sandblasting is stripped by use of an aqueous basic solution of sodium hydroxide, sodium carbonate or the like or a stripping solution for exclusive use for resists.

Then, baking at a predetermined temperature is conducted, whereby the partition walls 24 in a desired fine pattern are formed. The baking in this instance (partition wall baking step) is carried out in air at a temperature of about 560° C. for a period of 10 minutes.

Incidentally, by blackening the partition walls 24, the so-called black matrix can be formed, and enhancement of the contrast of the display screen can be contrived. Examples of the method of blackening the partition walls 24 include a method in which the partition walls are formed by use of a low melting point glass paste admixed with a black pigment.

Next, phosphor layer slurries for three primary colors are sequentially printed between the partition walls 24 formed on the second substrate 21. Thereafter, the second substrate 21 is baked in a baking furnace to form phosphor layers 25R, 25G, 25B over the region ranging from the areas on the dielectric film between the partition walls 24 to the areas on the side walls of the partition walls 24. The baking in this instance (phosphor baking step) is carried out in air at a temperature of about 510° C. The baking time is about 10 minutes.

Next, a plasma display device is assembled. Namely, first, a seal layer is formed on a peripheral portion of the second panel 20 by a screen printing method, for example. Next, as shown in FIG. 1, the first panel 10 and the second panel 20 are adhered onto each other, followed by baking to harden the seal layer. Thereafter, the spaces formed between the first panel 10 and the second panel 20 are evacuated, then a discharge gas is charged into the spaces, and the spaces are sealed off, whereby the plasma planar display device 2 is completed.

One example of the AC-glow discharge operation of the plasma display device constituted as above will be described. First, for example, a panel voltage higher than the discharge beginning voltage Vbd is impressed for a short time on all the discharge sustaining electrodes 12 on one side. By this, glow discharge is generated, wall charges are generated due to dielectric polarization on the surface of the dielectric layer 14 in the vicinity of the discharge sustaining electrodes 12 on one side, and the wall charges are accumulated, resulting in the apparent discharge beginning voltage being lowered. Thereafter, while a voltage is impressed on the address electrodes 22, a voltage is impressed on the discharge sustaining electrodes 12 on one side which are contained in the non-display discharge cells, whereby glow discharge is generated between the address electrodes 22 and the discharge sustaining electrodes 12 on one side, and the accumulated wall charges are eliminated. The elimination discharge is sequentially conducted for each of the address electrodes 22. On the other hand, no voltage is impressed on the discharge sustaining electrodes on one side which are contained in display discharge cells. By this, the accumulation of the wall charges is maintained. Thereafter, a predetermined pulse voltage is impressed between each pair of the discharge sustaining electrodes 12, whereby glow discharge is started between the pair of the discharge sustaining electrodes 12 in each of the cells in which the wall charges have been accumulated; in the discharge cell, the phosphor layer excited by being irradiated with vacuum ultraviolet rays generated based on the glow discharge in the discharge gas inside the discharge space emits light in the color peculiar to the kind of the phosphor layer material. Incidentally, the phases of the discharge sustaining voltages impressed respectively on the discharge sustaining electrodes on one side and on the discharge sustaining electrodes on the other side are staggered from each other by one half of the period, and the polarity of the electrodes is reversed according to the frequency of the AC.

According to the method of forming the partition walls 24 and the method of producing the planar display device 2 according to the present embodiment, the following actions or effects are displayed.

Namely, an abrasive constituted of calcium carbonate coated with silicone on the surfaces thereof is used as the abrasive in forming the partition walls 24. Since the abrasive is excellent in water repellency and fluidity, at the time of forming the partition walls 24 in the predetermined fine pattern, the abrasive can be effectively prevented from remaining stuck to the partition walls 24 or to the inside of the grooves and can be removed cleanly.

In addition, in the present embodiment, since each of the particles constituting the abrasive has the three-dimensional shape composed of a stack of different-sized triangular or more-angular polygonal layers, it is possible to form the partition walls 24 in the fine pattern at good grinding efficiency and with good accuracy, even if the mean particle diameter is set to be small.

Furthermore, by setting the maximum particle diameter of the abrasive to be not more than ½ times the width W1 of the partition walls 24 and setting the mean particle diameter of the abrasive to be not more than ⅕ times the width W1 of the partition walls 24, it is possible to process the partition walls 24 having a fine pitch and a fine width, without damaging the shape thereof. Particularly, by setting the maximum particle diameter of the abrasive to be not more than 10 μm, it is possible to process the partition walls 24 having the fine pitch and the fine width, without damaging the shape thereof.

The pitch P1 of the fine partition walls 24 formed by the method according to the present embodiment is not specifically limited, and it can not be more than 150 μm. Besides, the width W1 of the partition walls 24 can be not more than 50 μm, and the height H1 of the partition walls 24 can not be more than 300 μm.

In addition, in the present embodiment, the thickness of the resist film 30 used for forming the partition walls 24 is set to be not more than 1.2 times the partition wall width W1. Therefore, it is possible to form a fine width pattern free of exfoliation, collapse or undulation, the adhesion between the resist film 30 and the partition wall layer 24*a* formed of a low melting point glass paste can be secured, and the formation of the partition walls 24 having a fine pitch and a fine width is facilitated.

Furthermore, since the particle diameter of various frits constituting the low melting point glass paste for forming the partition walls 24 is set to be not more than ⅕ times the width W1 of the partition walls 24, it is possible to form the partition walls 24 which are fine and stable in shape.

Other Embodiments

The present invention is not limited to the above-described embodiment, and various modifications are possible within the scope of the invention.

For example, in the present invention, the specific structure of the plasma display device is not limited to the embodiment shown in FIG. 1, and it may be another structure. For example, while the so-called three-electrode-type plasma display device has been shown as an example in the embodiment shown in FIG. 1, the plasma display device according to the present invention may be the so-called two-electrode-type plasma display device. In this case, one of each pair of discharge sustaining electrodes is formed on the first substrate, and the other is formed on the second substrate. In addition, a projection image of the discharge sustaining electrodes on one side extends in a first direction, while a projection image of the discharge sustaining electrodes on the other side extends in a second direction different from the first direction (preferably, the second direction is substantially orthogonal to the first direction), and each pair of the discharge sustaining electrodes are oppositely arranged to face each other. It suffices that in the case of the two-electrode-type plasma display device, "the address electrodes" in the above description of the embodiment is read as "the discharge sustaining electrodes on the other side".

Besides, while the plasma display device according to the above-described embodiment is the so-called reflection-type plasma display device in which the first panel 10 is on the display panel side, the plasma display device according to the present invention may be a plasma display device of the so-called transmission type. In the transmission type plasma display device, however, the light emission from the phosphor layers is observed through the second panel 20, and, therefore, the address electrodes 22 which are provided on the second substrate 21 must be transparent, although the conductive material constituting the discharge sustaining electrodes may be transparent or opaque.

In addition, the method of forming the fine partition walls according to the present invention can be applied also to the case of forming fine partition walls used in a planar display device having a constitution different from that of the plasma display device constituted as described above. In that case, the pattern of the fine partition walls is not limited to the stripe form, and may be any of various other forms such as a rectangular wave form, a waffle form, a meander form, and so forth.

Now, the present invention will be described based on more specific examples, but the invention is not limited to these examples.

EXAMPLE 1

First, a low melting point glass paste having a mean particle diameter of not more than 4 μm was solid-printed by a screen printing method on a second substrate 21 formed of high strain point glass or soda glass, so as to obtain a predetermined height, to form a partition wall layer 24*a* as shown in FIG. 3A.

Next, the second substrate 21 was left to stand naturally (curing) for 5 minutes and then was dried at 120° C. to remove solvent components present in the paste. Thereafter, the substrate 21 was kept at 80° C.

Subsequently, a photosensitive dry film resist film 30 having a thickness of 20 μm was laminated on the surface of the partition wall layer 24*a* by use of a laminator.

Next, light exposure of the resist film 30 was conducted by use of a negative-type photomask patterned for a pitch of 90 μm and a partition wall width of 20 μm.

Subsequently, as shown in FIG. 3B, the substrate 21 provided thereon with the resist film 30 having undergone light exposure in the predetermined shape was developed with a 0.2% aqueous sodium carbonate solution to form a predetermined partition wall pattern.

Next, jet processing was conducted by a sandblasting technique using an abrasive (Misaki SHE-1; shown in FIGS. 4 and 5) consisting of calcium carbonate having a mean particle diameter of 3 μm and coated with silicone on the surfaces thereof to form partition walls 24 in a fine stripe pattern, as shown in FIG. 3C.

Subsequently, the remaining resist film 30 was stripped by use of a 2.5% aqueous sodium hydroxide solution.

In this manner, fine partition walls having a pitch of 90 μm, a width of 20 μm, and a height of 187 μm (before baking) were obtained, as shown in FIGS. 6 and 7.

EXAMPLE 2

Fine partition walls were formed in the same manner as in Example 1, except that a photosensitive dry film resist film 30 having a thickness of 16 μm was used, light exposure of the resist film 30 was conducted by use of a negative-type photomask patterned for a pitch of 78 μm and a partition wall width of 20 μm, and jet processing was conducted by use of an abrasive (Misaki #RC-1) consisting of calcium carbonate coated with silicone on the surfaces thereof, as shown in FIGS. 8 and 9.

As a result, fine partition walls having a pitch of 78 μm, a width of 20 μm, and a height of 178 μm (before baking) were obtained, as shown in FIGS. 10 and 11.

What is claimed is:

1. A method of forming fine partition walls, wherein fine partition walls are formed on the surface of a substrate by jet processing using an abrasive comprised of a powder of calcium carbonate coated with silicone on the surfaces thereof.

2. A method of forming fine partition walls as set forth in claim 1, wherein each of the particles constituting said abrasive has a three-dimensional shape comprised of a stack of different-sized triangular or more-angular polygonal layers.

3. A method of forming fine partition walls as set forth in any one of claims 1 to 2, wherein the particle diameter of various frits constituting a low melting point glass paste for forming said fine partition walls is not more than ⅕ times the width of said fine partition walls.

4. A method of forming fine partition walls as set forth in any one of claims 1 to 2, wherein the thickness of a resist layer used for forming said fine partition walls in a predetermined pattern is not more than 1.2 times the width of said fine partition walls.

5. A method of forming fine partition walls as set forth in claim 4, wherein the particle diameter of various frits constituting a low melting point glass paste for forming said fine partition walls is not more than ⅕ times the width of said fine partition walls.

6. A method of forming fine partition walls as set forth in any one of claims 1 to 2, wherein the pitch of said fine partition walls is not more than 150 μm, the width of said fine partition walls is not more than 50 μm, and the height of said fine partition walls is not more than 300 μm.

7. A method of forming fine partition walls as set forth in claim 6, wherein the thickness of a resist layer used for forming said fine partition walls in a predetermined pattern in not more than 1.2 times the width of said fine partition walls.

8. A method of forming fine partition walls as set forth in claim 6, wherein the particle diameter of various frits constituting a low melting point glass paste for forming said fine partition walls is not more than ⅕ times the width of said fine partition walls.

9. A method of forming fine partition walls as set forth in claim 1 or 2, wherein the maximum particle diameter of said abrasive is not more than ½ times the width of said fine partition walls, and the mean particle diameter of said abrasive is not more than ⅕ times the width of said fine partition walls.

10. A method of forming fine partition walls as set forth in claim 9, wherein the pitch of said fine partition walls is not more than 150 μm, the width of said fine partition walls is not more than 50 μm, and the height of said fine partition walls is not more than 300 μm.

11. A method of forming fine partition walls as set forth in claim 9, wherein the thickness of a resist layer used for forming said fine partition walls in a predetermined pattern is not more than 1.2 times the width of said fine partition walls.

12. A method of forming fine partition walls as set forth in claim 9, wherein the particle diameter of various frits constituting a low melting point glass paste for forming said fine partition walls is not more than ⅕ times the width of said fine partition walls.

13. A method of forming fine partition walls as set forth in claim 9, wherein the maximum particle diameter of said abrasive is not more than 10 μm.

14. A method of forming fine partition walls as set forth in claim 13, wherein the pitch of said fine partition walls is not more than 150 μm, the width of said fine partition walls is not more than 50 μm, and the height of said fine partition walls is not more than 300 μm.

15. A method of forming fine partition walls as set forth in claim 13, wherein the thickness of a resist layer used for forming said fine partition walls in a predetermined pattern is not more than 1.2 times the width of said fine partition walls.

16. A method of forming fine partition walls as set forth in claim 13, wherein the particle diameter of various frits constituting a low melting point glass paste for forming said fine partition walls is not more than ⅕ times the width of said fine partition walls.

17. A method of producing a planar display device comprising a first panel and a second panel, with discharge spaces being formed between said first panel and said second panel, wherein partition walls for partitioning said discharge spaces are formed on the surface of a second substrate constituting said second panel, by jet processing using an abrasive comprised of a powder of calcium carbonate coated with silicone on the surfaces thereof.

18. A method of producing a planar display device as set forth in claim 17, wherein each of the particles constituting said abrasive has a three-dimensional shape comprised of a stack of different-sized triangular or more-angular polygonal layers.

19. A method of producing a planar display device as set forth in any one of claims 17 to 18, wherein the particle diameter of various frits constituting a low melting point glass paste for forming said fine partition walls is not more than ⅕ times the width of said fine partition walls.

20. A method of producing a planar display device as set forth in any one of claims 17 to 18, wherein the thickness of a resist layer used for forming said fine partition walls in a predetermined pattern is not more than 1.2 times the width of said fine partition walls.

21. A method of producing a planar display device as set forth in claim 20, wherein the particle diameter of various frits constituting a low melting point glass paste for forming said fine partition walls is not more than ⅕ times the width of said fine partition walls.

22. A method of producing a planar display device as set forth in any one of claims 17 to 18, wherein the pitch of said fine partition walls is not more than 150 μm, the width of said fine partition walls is not more than 50 μm, and the height of said fine partition walls is not more than 300 μm.

23. A method of producing a planar display device as set forth in claim 22, wherein the thickness of a resist layer used for forming said fine partition walls in a predetermined pattern is not more than 1.2 times the width of said fine partition walls.

24. A method of producing a planar display device as set forth in claim 22, wherein the particle diameter of various frits constituting a low melting point glass paste for forming said fine partition walls is not more than ⅕ times the width of said fine partition walls.

25. A method of producing a planar display device as set forth in claim 17 or 18, wherein the maximum particle diameter of said abrasive is not more than ½ times the width of said fine partition walls, and the mean particle diameter of said abrasive is not more than ⅕ times the width of said fine partition walls.

26. A method of producing a planar display device as set forth in claim 25, wherein the pitch of said fine partition walls is not more than 150 μm, the width of said fine partition walls is not more than 50 μm, and the height of said fine partition walls is not more than 300 μm.

27. A method of producing a planar display device as set forth in claim 25, wherein the thickness of a resist layer used for forming said fine partition walls in a predetermined pattern is not more than 1.2 times the width of said fine partition walls.

28. A method of producing a planar display device as set forth in claim 25, wherein the particle diameter of various frits constituting a low melting point glass paste for forming said fine partition walls is not more than ⅕ times the width of said fine partition walls.

29. A method of producing a planar display device as set forth in claim 25, wherein the maximum particle diameter of said abrasive is not more than 10 μm.

30. A method of producing a planar display device as set forth in claim 29, wherein the pitch of said fine partition walls is not more than 150 μm, the width of said fine partition walls is not more than 50 μm, and the height of said fine partition walls is not more than 300 μm.

31. A method of producing a planar display device as set forth in claim 29, wherein the thickness of a resist layer used for forming said fine partition walls in a predetermined pattern is not more than 1.2 times the width of said fine partition walls.

32. A method of producing a planar display device as set forth in claim 29, wherein the particle diameter of various frits constituting a low melting point glass paste for forming said fine partition walls is not more than ⅕ times the width of said fine partition walls.

33. An abrasive for jet processing, comprised of a powder of calcium carbonate coated with silicone on the surfaces thereof, wherein each of the particles constituting said abrasive has a three-dimensional shape comprised of a stack of different-sized triangular or more-angular polygonal layers.

34. An abrasive for jet processing as set forth in claim 33, wherein the maximum particle diameter of said abrasive is not more than 10 μm.

* * * * *

UNITED STATES PATENT AND TRADEMARK OFFICE

CERTIFICATE OF CORRECTION

PATENT NO. : 6,910,937 B2
DATED : June 28, 2005
INVENTOR(S) : Eitaro Yoshikawa

It is certified that error appears in the above-identified patent and that said Letters Patent is hereby corrected as shown below:

Title page,
Item [54], Title, should read:
-- METHOD OF FORMING FINE PARTITION WALLS, METHOD OF PRODUCING PLANAR DISPLAY DEVICE, AND ABRASIVE FOR JET PROCESSING --.

Signed and Sealed this

Twentieth Day of December, 2005

JON W. DUDAS
*Director of the United States Patent and Trademark Office*